US008756143B1

(12) United States Patent
Ritter

(10) Patent No.: US 8,756,143 B1
(45) Date of Patent: Jun. 17, 2014

(54) COMPUTER-AIDED AUCTIONING METHOD AND AUCTIONING SYSTEM

(75) Inventor: Rudolf Ritter, Zollikofen (CH)

(73) Assignee: Swisscom AG, Bern (CH)

( * ) Notice: Subject to any disclaimer, the term of this patent is extended or adjusted under 35 U.S.C. 154(b) by 1974 days.

(21) Appl. No.: 10/130,304

(22) PCT Filed: Nov. 27, 2000

(86) PCT No.: PCT/CH00/00632

§ 371 (c)(1),
(2), (4) Date: May 31, 2002

(87) PCT Pub. No.: WO01/42999

PCT Pub. Date: Jun. 14, 2001

(30) Foreign Application Priority Data

Dec. 6, 1999 (CH) ..... 2235/99

(51) Int. Cl.
*G06Q 40/00* (2012.01)

(52) U.S. Cl.
USPC ..... 705/37

(58) Field of Classification Search
USPC ..... 705/35–40
See application file for complete search history.

(56) References Cited

U.S. PATENT DOCUMENTS

| | | | | |
|---|---|---|---|---|
| 4,903,201 | A * | 2/1990 | Wagner | 705/37 |
| 5,404,580 | A * | 4/1995 | Simpson et al. | 455/558 |
| 5,835,896 | A * | 11/1998 | Fisher et al. | 705/37 |
| 5,842,178 | A * | 11/1998 | Giovannoli | 705/26.4 |
| 5,987,606 | A | 11/1999 | Derosa et al. | |
| 6,058,417 | A | 5/2000 | Hess et al. | |
| 6,091,956 | A * | 7/2000 | Hollenberg | 455/456.5 |
| 6,125,353 | A * | 9/2000 | Yagasaki | 705/27 |
| 6,415,269 | B1 * | 7/2002 | Dinwoodie | 705/36 R |
| 6,473,739 | B1 * | 10/2002 | Showghi et al. | 705/26 |
| 7,003,792 | B1 * | 2/2006 | Yuen | 725/46 |
| 7,219,080 | B1 * | 5/2007 | Wagoner et al. | 705/37 |

FOREIGN PATENT DOCUMENTS

| | | |
|---|---|---|
| EP | 0 716 386 | 6/1996 |
| EP | 0 987 644 | 3/2002 |

OTHER PUBLICATIONS

B. Garda et al.: "Building and running online auctions" Dr. Dobb'S Journal, vol. 22, No. 10, pp. 84, 86-88, 91-88, 91, 104 Oct. 1997.

* cited by examiner

*Primary Examiner* — Olabode Akintola
(74) *Attorney, Agent, or Firm* — McAndrews, Held & Malloy, Ltd.

(57) ABSTRACT

A computer-based auction method and auction system in which vendors offer products, services and/or information as auction objects, auction object data relating to the auction objects being captured in an input module and being disseminated over telecommunications channels, and in which interested customers make auction bids for offered auction objects, bid data being prepared and being sent over a telecommunications network to an evaluation unit, where they are evaluated and the best bid for the auction object is determined, class designations based on a predefined object classification being inserted into the auction object data and the auction object data being filtered based on customer-specific object profiles, and during the preparation of the bid data in the communication terminal of the customer a bid amount entered by the interested customer is linked to at least certain data contained in the auction object data.

18 Claims, 3 Drawing Sheets

COMPUTER-AIDED AUCTIONING METHOD AND AUCTIONING SYSTEM

The present invention relates to a computer-based auction method and a computer-based auction system in which vendors offer for sale products, services and information, and interested customers are able to make auction bids at far away locations, the transmission of the product offers and auction bids taking place over telecommunication channels.

Traditional auctions require the presence of the customer or bidder at the auction. In addition, the goods are brought to the location of the auction for view. The prior submission by letter of an auction bid or the transmission of an auction bid by telephone, telex or fax does relieve the customer from the burden of presence at the auction. At larger auctions, however, the customer is normally dependent upon a representative, who participates for him in the auction. Traditional auctions are therefore not very attractive for many clients.

The spread of email led to the introduction of email auctions, whereby, to begin with, an auctioneer still had to receive the email bids and enter them in a database. It was only in the following years that a completely computer-based auction system came into being. The powerful spread of the Internet contributed significantly thereby to computer-based online auctions becoming known in general. Most of these online auction systems have a central host computer or server on the product vendor side which is connected via a LAN (Local Area Network), WAN (Wide Area Network), or, as already mentioned, via the Internet with a multiplicity of remote terminals on the customer side, the functions of an auction system of this kind being implemented in a computer program.

The document U.S. Pat. No. 5,835,896 shows the current state of the art. The document U.S. Pat. No. 5,835,896 describes a system and a method for processing and transmitting information in electronic auctions, which do without the person of an auctioneer. The described auction method and auction system makes it possible for interested bidders (referred to as customers in the further description) to select products from a catalogue page transmitted to a customer terminal and to enter interactively bid offers (referred to as auction bids in the further description). The auction system automatically evaluates the auction bids of the customers, continuously informs the customers about the state of the auction, the customers being able to enter further auction bids. Following close of the auction, the auction system informs the successful customers and the losers about the outcome of the auction. The auction system consists of a host computer and a computer network which connects the host computer to a plurality of remotely situated customer terminals, and is implemented as computer program on the host computer and computer network. The auction system described further comprises means of disseminating information over the computer network about the products offered for sale, entry means via which interested customers can enter auction bids for the auction objects offered for sale, reception means for receiving the auction bids entered by the customers, and evaluation means in order to divide automatically the auction bids received into successful and not successful auction bids.

The auction methods and auction systems according to the state of the art have the drawback that they are implemented within a single computer network. The current situation in the field of telecommunications is characterized in that the transmission environment is heterogeneous. The auction methods and auction systems according to the state of the art and the transmission methods and transmission systems used therein are hardly suitable for coping with this new situation.

A further problem relates to the flood of information with which potential customers are confronted. The customer would like, on the one hand, to be able to select from among a wide range of products, and, on the other hand, not invest unnecessary time in looking through the product offers that do not interest him. The auction methods and auction systems according to the state of the art and the transmission methods and transmission systems used therein have neglected this problem so far.

It is the object of the present invention to propose a new and better auction method and a new and better auction system which do not have the above-mentioned drawbacks of the state of the art.

These objects are achieved according to the present invention in particular through the features of the independent claims. Further advantageous embodiments follow moreover from the dependent claims and from the description.

These objects are achieved according to the invention in particular in that the auction objects are classified based on a predefined object classification, and the corresponding class designations are inserted into the auction object data, and the auction object data are filtered during later use based on customer-specific object profiles, as well as through the fact that, for each bid, during the preparation of the bid data, a bid amount entered by the interested customer is linked in the communication terminal of the customer with at least certain of the data contained in the auction object data, and/or data assigned to the auction object data, such as e.g. with an object code.

The present invention can be used on computer-based auction methods and computer-based auction systems in which vendors offer products, services and/or information for sale as auction objects. The classification of the auction objects takes place preferably during the capturing of the auction object data. One or more class designations are thereby assigned to an auction object based on a predefined object classification, and the class designations or a corresponding classification code are inserted into the auction object data belonging to this auction object. On the basis of the class designations contained in the auction object data, the auction object offers can be filtered in a simple way. The filtering can take place e.g. in the communication terminal of the customer, whereby the customer is not burdened by undesired auction object offers. The filtering takes place on the basis of customer-specific profiles which are likewise based on the above-mentioned predefined object classification. On the side of the product vendor, the classification of offered objects has the advantage that it facilitates a more efficient marketing in that it is possible to appeal to selected customer segments in a targeted way.

A further advantageous feature of the invention consists in that, in the communication terminal of the customer, during the preparation of the bid data, the bid amount entered by the customer is linked with at least certain of the data contained in the auction object data, and/or data assigned to the auction object data, such as e.g. with the already mentioned object code. The said linking serves the purpose of assigning the entered bid amount to an auction object offer. The customer identification is inserted into the bid data in the communication terminal of the customer or at a later point in time, depending upon the embodiment variant. In an embodiment variant, an electronic signature is inserted into the bid data e.g. in the communication terminal of the customer. The electronic signature is checked in the receiving module which receives the bid data, and the respective customer is thereby authenticated, and the name and address of the customer is added to the bid data. The combining into a bid data packet of all important information for an auction bid makes possible transmission over any telecommunication network, such as, e.g. the Internet, Internet mobile or mobile radio telephone networks, for instance UMTS, GSM or satellite-based mobile radio networks, using SMS (Short Message Service), USSD (Unstructured Supplementary Service Data) or WAP (Wireless Application Protocol), and has great advantages in a heterogeneous transmission environment.

The auction object data preferably contain additional information for identification of the vendor or of the evaluation unit, for example the address, the domain name or a code for the vendor or the evaluation unit. The information for identification of the vendor or of the evaluation unit can be used during the transmission of the auction bids to transmit the auction bids to the corresponding destination addresses.

Preferably the auction object data belonging to a particular auction object are disseminated in a data packet with uniform data structure. The combination of all offer object data into an offer data packet allows the transmission over any telecommunication channel, such as e.g. DAB (Digital Audio Broadcasting), DVB (Digital Video Broadcasting) or telecommunication networks such as e.g. the Internet, Internet Mobile or mobile radio telephone networks, for example UMTS, GSM or satellite-based mobile radio telephone networks, using SMS, USSD or WAP and has great advantages in a heterogeneous transmission environment.

In a preferred embodiment variant, a check sum is generated for the auction object data, which check sum is transmitted together with the auction object data, the error-free transmission of the auction object data being checked with the aid of the check sum. For generation of the check sum, any known error checking or error correcting algorithm can be used, e.g. a parity control algorithm, which determines the parity of at least part of the auction object data. The check sum (i.e. in the example the parity) is transmitted together with the auction object data. The telecommunication system or the communication terminal of the customer contains means of determining the check sum of the transmitted auction object data and of comparing it with the transmitted check sum. If the comparison turns out to be negative, an alarm is set off, for instance a message is generated, the transmission stopped, or the selection or the display of the respective auction object data suppressed. Depending upon the type of algorithm used, an error correction is also possible.

In a further preferred embodiment variant, the customer receives a confirmation of his auction bid. To this end, for example, the receiving module, which receives the auction bids, can generate a confirmation message and send it to the customer over a telecommunication network. The transmission can take place, for instance, via a GSM radio telephone network using SMS, USSD or WAP or via Internet <sic. Internet Protocol (IP)> or via Internet Mobile <sic. Mobile IP>.

The embodiment example will be more closely described with reference to the following figures.

Figure 1:
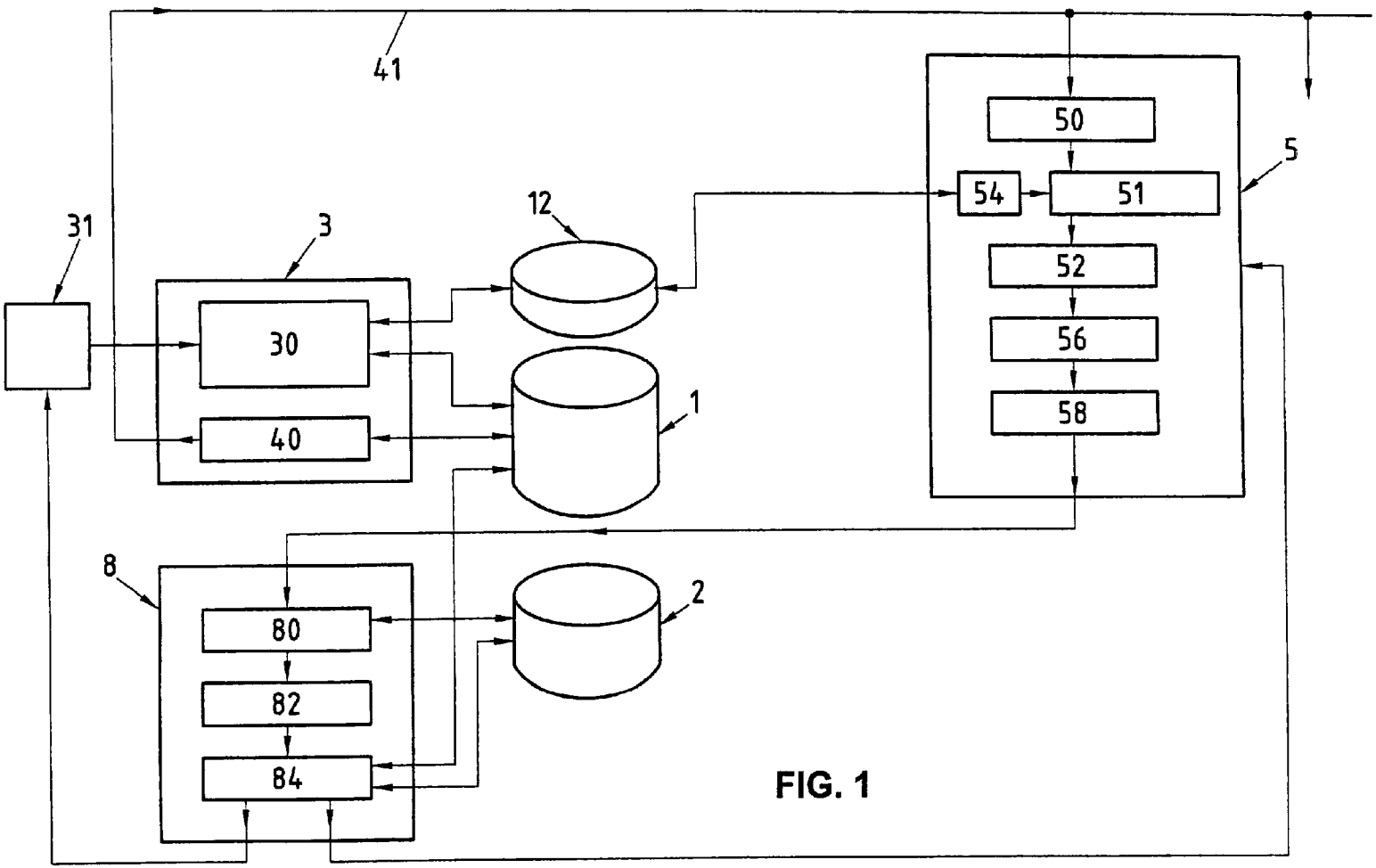
FIG. 1 shows a block diagram of the embodiment example.

FIG. 1 illustrates in a diagrammatical way the structure in principle of an auction system according to an embodiment variant of the present invention. The reference numeral 1 designates a database, which administers the auction object data for the auction object offers. The auction system further comprises an offer unit 3 with an input module 30 for entry and processing of the auction object offers, which is implemented as computer program, as well as a transmission module 40 for dissemination of the auction object offers. Auction object offers can be entered via an input terminal 31. The input terminal 31 is linked to the input module 30 via a communication network, e.g. a fixed network, for instance the public switched telephone network, an ISDN network or the Internet, or a mobile network, for instance a UMTS or GSM network via e.g. WAP. Alternatively the auction object vendor can also avail of the services of an acceptance office.

Figure 2:
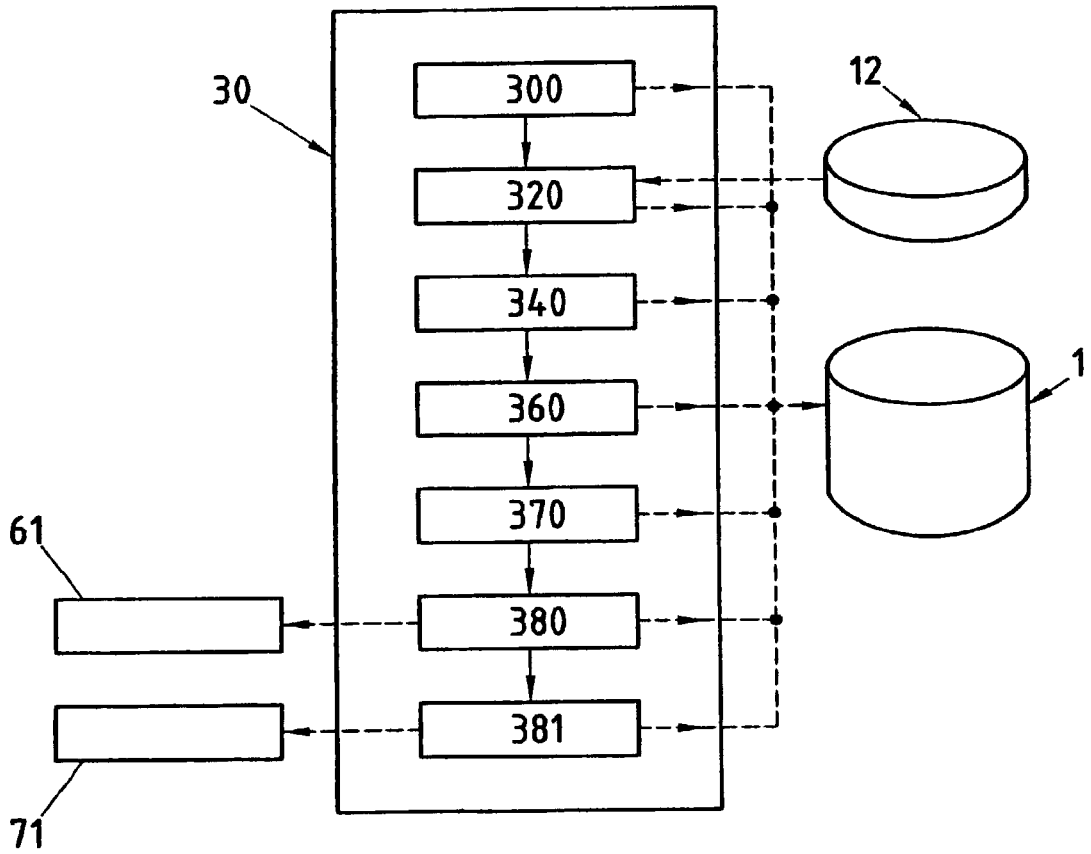
FIG. 2 shows a block diagram of the input module for entry of the offers.

The block diagram for the entry and processing of auction object offers is shown in FIG. 2. The identification data of the auction object vendor are captured in step 300. In step 320, the input module requests the entry of a product segment and a product group (The product segments form the uppermost hierarchy level in the object classification, the product groups the next lower hierarchy level). To this end, the input module 30 has access to the object classification table 12, so that during the entry a fitting product segment and a fitting product group can be selected from the object classification table 12. The entry of a plurality of product segments or product groups is also possible. Provided for optionally is also the selection of product subgroups and of possible groups subordinate to the subgroups. The part of the input module corresponding to step 320 is also called the classification module in the following. In step 340, the entry of the product designation and of the product details takes place such as, for example, type designation, model or year, and step 360 makes possible the entry of multimedia components such as, for instance, pictures or announcements. Step 370 serves the capturing of information relating to the auction such as, e.g. quantity, minimum price, auction "ultimo" (i.e. the point in time up until which auction bids can be made), action (i.e. purchase or sale), auction method (i.e. Dutch auction or progressive auction) and the geographic area (e.g. global, regional, national, local, and, if applicable, with place indications). The data entered in steps 300 to 370 are stored in the database 1. In step 380 an object code 61 is generated for each auction object offer. In the present embodiment example, the object code 61 has the same structure as the order code in the patent application WO 98/28900 of the applicant (see FIG. 1, Pos. 11 in WO 98/28900).

Figure 3:
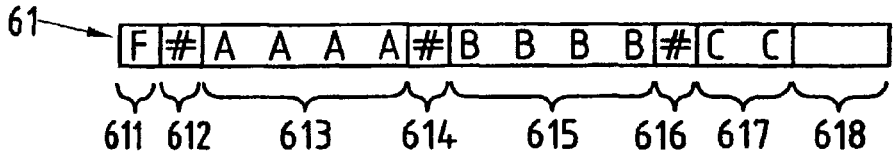
FIG. 3 shows the data structure of the object code in the embodiment example.

FIG. 3 shows the object code 61 in detail. The object code contains the fields 611 to 618. The field 611 contains a designator which designates the type of object code or the service. The second field 613, separated from the first field 611 by a field delimiter 612, serves the designation of the vendor and contains, for instance, the address or a code for the vendor. In an embodiment variant, the field 613 contains the address or a code for the receiving module that receives the auction bids during the auction. The third field 615, separated from the second field 613 by a field delimiter 614, contains the designation of the auction object offered for sale. A further field 617, separated from the field 615 by a field delimiter 616, contains a check sum with the aid of which the error-free transmission of the auction object data can be checked. The last field 618 is optional, and can contain e.g. a transaction code. In an embodiment variant, the fields have fixed lengths, whereby it is possible to do without the field delimiters.

Figure 4:
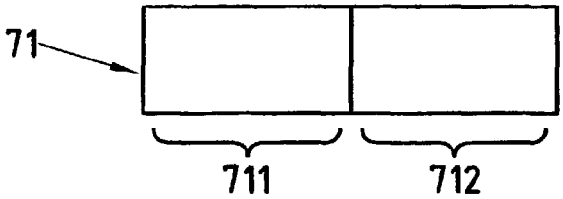
FIG. 4 shows the data structure for the dissemination of the auction object offers.

In step 381, the object code 61 is linked with the information entered under 310 to 370, and a unified offer data packet 71 is created from the object code and the auction object data, the structure of which is shown in FIG. 4. The offer data packet 71 consists of two parts in the described example. Contained in the first part 711 are the auction object data entered under 310 to 370. The second part 712 consists of the object code 61. The transmission module 40 controls the dissemination of the offer data packet 71 over the various telecommunications channels 41, such as e.g. DAB (in particular PAD (Program Associated Data) or NPAD (Non-Program Associated Data)), DVB, Internet (preferably by means of push technology) and/or Mobile Broadcast. The traditional distribution via printed media is of course also possible (the screen or display unit appears in this case as an advertisement).

Figure 5:
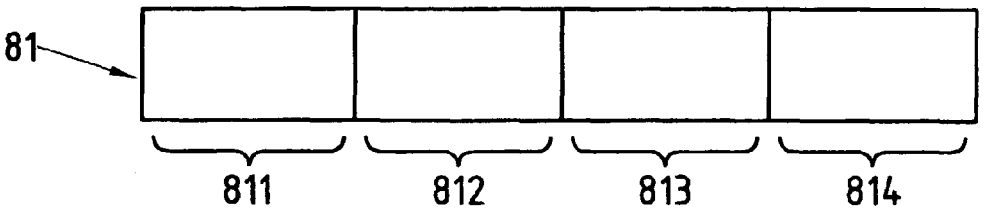
FIG. 5 shows the data structure for the transmission of the bid data.

The communication terminal 5 of the customer has a receiving module 50 for receiving the offer data packet 71, a filter module 51 for selection of the auction object offers and for storage of the selected auction object offers, and a display module 52 for selection and display of the selected auction object offers. A further module 54 has access to the object classification list 12 and makes it possible for the customer to draw up object profiles corresponding to his interests. The filter module 51 selects and stores all auction object offers whose classifications correspond to the object profile drawn up by the customer. If the customer uses a communication terminal with SIM card, for example, the object profiles as well as the selected offers can thus be stored on the SIM card or in the terminal. With the aid of the display module 52, the customer can select an offer that interests him and can enter an auction bid for it in a communication terminal 5. The entry takes place via the bid input module 56, which is implemented as computer program, and comprises at least one bid amount. If the same apparatus is used for entry of the auction bid and for display of the selected auction object offer, as in the present embodiment example, by selecting a particular auction object offer, it is already determined to which auction object offer the auction bid refers. If there is no direct connection between the displaying communication terminal and the input device, then the customer must enter at least certain data contained in the auction bid data <sic. auction object data>, and/or data assigned to the auction object data, preferably the object code 61, in addition to the bid amount. The bid input module 56 links the entered bid amount to at least certain data contained in the auction bid data <sic. auction object data>, for example to the object code 61, and draws up a unified bid data packet 81, the structure of which is shown in FIG. 5, from the bid amount and the certain data contained in the auction bid data <sic. auction object data>. The complete bid data packet 81 consists of four parts in the embodiment example. The first two parts 811 and 812 correspond to the content of the parts 711 and 712 in the offer data packet 71 (part 712 or respectively 812 thereby contains the object code 61). The field 811 contains offer object data and is optional. The third part 813 contains the bid amount, and the fourth part 814 information for identification of the customer. The customer identification will be gone into in particular in the following. The bid data packet 81 is transmitted by the transmission module 58 over a telecommunications network to the receiving module 80. The transmission can take place e.g. as SMS or USSD message or via Internet, Internet Mobile or WAP.

The identification of the customer can occur in various ways: In the simplest case, the customer enters his name and address together with the bid amount during entry of the auction bid. The bid input module 56 then inserts name and address into the bid data, as part 814 of the bid data packet 81 in the embodiment example. In an embodiment variant, the customer uses a communication terminal for entry of the auction bid, which terminal makes possible identification of the customer, e.g. a GSM mobile radio telephone with SIM card or a PC that is connected to the Internet. In both cases, the network operator or respectively Internet provider has available the necessary information to identify the customer during the transmission of the auction bid and, with reference to the subscriber database 2, to transmit the address of the customer. The completion of the bid data (the addition of the name and address of the customer) takes place in this variant at a later point in time, e.g. in the receiving module 80 of the evaluation unit 8. In a further embodiment variant, electronic signatures can be generated with the communication terminal used by the customer for entry of the auction bid. In this case, the other side, in this embodiment example the receiving module 80, must possess an authentication function. The bid input module 56 inserts the electronic signature as part 814 into the bid data packet, and the receiving module 80 supplements the part 814 with the name and address of the customer following the authentication by means of the signature. If the billing address is taken from the subscriber database 2, as shown in FIG. 1, the customer can define in addition a delivery address and enter it e.g. via WAP or Internet.

In the present embodiment example, the evaluation unit 8 contains a receiving module 80, an evaluation module 82 and a transaction module 84, which are implemented as computer programs. The receiving module 80 supplements the bid data with additional information from the subscriber database 2, such as e.g. the language or nationality of the customer. The auction bids are evaluated and stored in the evaluation module 82. The evaluation module 82 ascertains the best offers, draws up a ranking list, and informs customers and interested viewers about the state and result of the auction, e.g. via Internet query, SMS, USSD, DAB (NPAD) or DVB. The auction runs until the deadline indicated in the auction offer. After expiry of the deadline, the transaction module 84 takes over the successful auction bid or bids for settlement of the purchase/sales transaction. For this purpose, the transaction module 84 sends a message about the outcome of the auction to the highest bidder or highest bidders as well as to the vendor of the auction object offer. This can occur, for example, via SMS, USSD, WAP or Internet. The actual purchase/sales transaction is completed with the confirmation of this message.

Table 1 shows the content of the auction object data and of the bid data using the example of an auction offer for a go-cart.

TABLE 1

| Auction object data | | Object code | Bid data |
|---|---|---|---|
| Designator | [FA] | Designator [F] | Bid amount [Fr. 1450] |
| Product segment | [sports] | Vendor [ABC] | |
| Product group | [motor sports] | Object [A1X27F] | Signat [function]<sic.> |
| Product subgroup | [cart] | Check- [E7] | |
| Product designation | [Swisskutless] | sum | Signature [function] |
| Product details | [type A19, mod. 1997] | | |
| Quantity | [1 piece] | | |
| Minimum price | [Fr. 1400] | | |
| Auction ultimo | [1. Dec 1999, 6 p.m.] | | |
| Action | [purchase] or [sale] | | |
| Auction method | [Dutch auction] | | |
| Offer data packet | | Bid data packet | |

What is claimed:

1. A computer-based auction method for preparing auction bids on auction objects that are for sale, the method performed on an offer unit, a communication terminal operated by a customer, and a evaluation device, comprising:

entering offer data at an input device of the offer unit, by entering data on an offer of an auction object that is for sale by auction, by entering class designation corresponding to the auction object based on a predefined object classification scheme by selecting a product segment that fits the auction object from a object classification table that is available at the offer unit, and by entering auction data including auction method and minimum sales price for the auction;

generating auction offer data at the offer unit as a unified data packet for each auction including the offer data specifying the offer of the auction object, the class designation corresponding to the auction object, and the auction data;

transmitting the unified data packet with the auction offer data from a transmission device of the offer unit to the communication terminal of the customer;

filtering at the communication terminal the auction offer data based on a customer-specific profile that corresponds to the customer to generate customer-specific offer data from the unified data packet including information on customer-specific auction objects, the filtering performed by a filter unit that stores the customer-specific profile at the communication terminal;

entering a bid including a bid amount for at least one auction object of the customer-specific offer data at the communication terminal, the at least one auction object identified by the customer;

linking the bid amount, information on the identified at least one auction object, and an identification information of the bidding customer to form customer bid data with a linking module of the communication terminal;

sending the customer bid data from the communication terminal to the evaluation device via a cellular phone network;

evaluating the bid at the evaluation device and generating a message with an outcome of the bidding; and sending the message with the outcome of the bidding from the evaluation device to the offer unit.

2. The computer-based auction method according to claim 1, further comprising:

displaying information related to the at least one auction object of the customer-specific offer data with the communication terminal to allow identification of the at least one auction object by the customer.

3. The computer-based auction method according to claim 1, further comprising:

reading the identification information of the bidding customer form a storage unit in the communication terminal of the customer.

4. The computer-based auction method according to claim 1, generating a check sum from the auction offer data, and including the check sum into the auction offer data, before transmitting the auction offer data.

5. The computer-based auction method according to claim 4, verifying the check sum of the auction offer data after said step of transmitting the auction offer data to detect transmission errors.

6. The computer-based auction method according to claim 1, wherein said step of entering offer data includes:

entering at least one of a duration of the auction, and a geographic area of the auction.

7. The computer-based auction method according to claim 1, wherein the identification information of the bidding customer is stored in the communication terminal in a removable identification module.

8. The computer-based auction method according to claim 7, wherein the removable identification module stores the customer-specific profile.

9. The computer-based auction method according to claim 1, wherein said step of entering offer data includes entering identification data that identifies a vendor of the auction object, and said step of generating auction data includes the vendor identification data.

10. A computer-based auction system configured to prepare auction bids for auction objects that are for sale, comprising:

an offer unit having an input unit, a processing unit, and a transmission unit, the input unit configured to receive offer data specifying an offer of an auction object that is for sale by auction; to receive class designation corresponding to the auction object based on a predefined object classification scheme by a selection of a product segment that fits the auction object from a object classification table that is available at the offer unit, and to receive auction data including auction method and minimum sales price for the auction;

the processing unit configured to generate auction offer data for the auction object as a unified data packet for each auction including the offer data specifying the offer, the class designation corresponding to the auction object, and the auction data;

and the transmission unit configured to transmit the unified data packet with the auction offer data to a communication terminal of a customer;

the communication terminal operated by a customer having a filtering unit, an input unit, a linking unit, and a sending unit, the filtering unit configured to filter the auction offer data based on a customer-specific profile that corresponds to the customer to generate customer-specific offer data including information on customer-specific auction objects, the input unit configured to receive a bid amount for at least one auction object of the customer-specific offer data identified by the customer;

the linking unit configured to link the bid amount, information on the identified at least one auction object, and an identification information of the bidding customer to form customer bid data, and the sending unit configured to send the customer bid data to an evaluation device via a cellular phone network; and the evaluation device configured to evaluate the bid and to generate a message with an outcome of the bidding, and to send the message with the outcome of the bidding from the evaluation device to the offer unit.

11. The computer-based auction system according to claim 10, further comprising:

a display unit configured to show information related to the at least one auction object of the customer-specific offer data with the communication terminal to allow identification of the at least one auction object by the customer.

12. The computer-based auction system according to claim 10, wherein said processing unit is configured to read the identification information of the bidding customer form a storage unit in the communication terminal of the customer.

13. The computer-based auction system according to claim 10, wherein said processing unit is configured to generate a check sum from the auction offer data, and to include the check sum into the auction offer data, before transmitting the auction offer data.

14. The computer-based auction system according to claim 13, wherein said processing unit is further configured to verify the check sum of the auction offer data after the auction offer data is transmitted to detect transmission errors.

15. The computer-based auction system according to claim 10, wherein the input unit is further configured to receive at least one of a duration of the auction, and a geographic area of the auction, or a minimum price for the auction object.

16. The computer-based auction system according to claim 10, further comprising:

a removable identification module located in said communication terminal, configured to store the identification information of the bidding customer.

17. The computer-based auction system according to claim 16, wherein the removable identification module is further configured to store the customer-specific profile.

18. The computer-based auction system according to claim 10, wherein the input unit is further configured to receive identification data that identifies a vendor of the auction object, and the processing unit is further configured to generate auction data that also includes the vendor identification data.

* * * * *